United States Patent [19]

Iijima et al.

[11] 4,278,526

[45] Jul. 14, 1981

[54] APPARATUS FOR ELECTROLYSIS OF AN AQUEOUS ALKALI METAL CHLORIDE SOLUTION

[75] Inventors: Tokuzo Iijima, Kobe; Yasushi Samejima, Kakogawa; Kazuo Kishimoto; Takamichi Komabashiri, both of Takasago; Toshiji Kano, Kobe, all of Japan

[73] Assignee: Kanegafuchi Kagaku Kogyo Kabushiki Kaisha, Osaka, Japan

[21] Appl. No.: 104,773

[22] Filed: Dec. 18, 1979

[30] Foreign Application Priority Data

Dec. 28, 1978 [JP] Japan ..... 53-163590
Jul. 2, 1979 [JP] Japan ..... 54-91757[U]

[51] Int. Cl.[3] ..... C25B 9/00
[52] U.S. Cl. ..... 204/266
[58] Field of Search ..... 204/266, 98

[56] References Cited

U.S. PATENT DOCUMENTS

| | | | |
|---|---|---|---|
| 3,755,108 | 8/1973 | Raetzsch et al. | 204/98 |
| 3,855,091 | 12/1974 | Piester | 204/98 |
| 4,130,468 | 12/1978 | De Nora et al. | 204/98 |
| 4,147,599 | 4/1979 | O'Leary et al. | 204/98 |
| 4,173,524 | 11/1979 | McRae | 204/266 |

*Primary Examiner*—R. L. Andrews
*Attorney, Agent, or Firm*—Armstrong, Nikaido, Marmelstein & Kubovcik

[57] ABSTRACT

Apparatus for the electrolysis of an aqueous alkali metal chloride solution using a cation exchange membrane, wherein the apparatus is designed so that gas-liquid interface, at which halogen gas is separated, is maintained larger than the sum total of the cross section area of the unit anode chambers opposing to cathodes, and further, higher than the upper end of the cation exchange membrane. The invention has numerous advantages including substantial absence of halogen gas, operation at a low voltage, a high pure product, simplification of operation control and the like.

4 Claims, 4 Drawing Figures

APPARATUS FOR ELECTROLYSIS OF AN AQUEOUS ALKALI METAL CHLORIDE SOLUTION

DETAILED DESCRIPTION OF THE INVENTION

Figure 1:
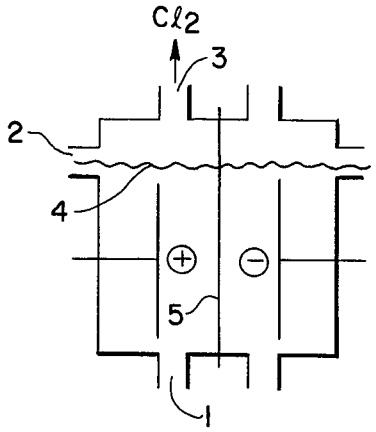

The present invention is directed to a novel apparatus for the electrolysis of an aqueous alkali metal chloride solution, using a cation exchange membrane.

Halogen and alkali metal hydroxide have been normally produced on an industrial scale by mercury electrolysis processes or diaphragm electrolysis processes. Mercury electrolysis processes, however, raise the environmental pollution due to escape of mercury to the environment, and thus have recently been decreased in the rate of operation. Diaphragm electrolysis processes, on the other hand, are carried out using an electrolytic cell which is partitioned by a liquid-transportable diaphragm composed commonly of asbestos into an anode chamber and a cathode chamber, each chamber having an anode or a cathode. In operating the electrolytic cell, brine is introduced into the anode chamber where halogen gas is produced in the anode chamber, subsequently brine is passed with an alkali metal ion through the diaphragm into the cathode chamber where alkali metal hydroxide is produced. Alkali metal hydroxide so obtained contains a fairly great amount of alkali metal halide, and thus the use thereof is limited.

In recent years, there has been proposed use of a permselective cation exchange membrane in the place of a conventional diaphragm. Such membranes are substantially impervious to the hydrodynamic flow of liquid, while electically conductive. In the operation of a membrane electrolytic cell, brine is introduced into the anode chamber where halogen is produced at the anode. Consequently, alkali metal ion is then selectively transported through the membrane into the cathode chamber. Alkali metal ion reacts with hydroxide ion generated at the cathode by the electrolysis of water to produce alkali metal hydroxide.

Ion exchange membrane electrolysis processes have an outstanding advantage of producing relatively pure alkali metal hydroxide at high concentrations, as compared with any conventional diaphragm electrolysis process.

As an electrolytic cell suitable for practicing ion exchange electrolysis processes, a filter-press type electrolytic cell is commonly well known to the art. In filter-press type electrolytic cells conventionally employed, a unit cell is composed of an anode chamber and a cathode chamber separated by a cation exchange membrane, and several tens of unit cells are linked to form a stack. Most important requirement in operation is to maintain the same concentration of anolyte and catholyte solutions in several tens of unit cells forming a stack. For this purpose, following two processes are normally conducted.

One process is proposed wherein the feed amounts of brine and catholyte diluting water, which are supplied into each anode or cathode chamber of the several tens of unit cells, are controlled individually and separately.

Another is to introduce anolyte solutions or catholyte solutions to each receiving tank, respectively, then recirculate by pumps each solution to anode or cathode chambers, thereby providing uniform concentrations of anolyte and catholyte solutions in the unit cells.

Notwithstanding, the first process is terribly troublesome in control and thus not suitable for an industrial scale practice. The second process has numerous disadvantages, though usually employed, including leakage of current due to the circulation of a great amount of solutions, loss of current efficiency, erosion of the apparatus. The increased cost for circulation equipment and maintenance provides another disadvantage for industrialization of the process. Moreover, halogen gas generated in the anode chambers is generally removed from the cells together with a great amount of recycled solutions, and then separated from liquid by a gas-liquid separator. This conventional process, nevertheless, never fails to require the gas-liquid separator, and further invites the residence of halogen gas in a unit anode chamber, thus resulting in the increased voltage. Stated more particularly, a filter press type electrolytic cell widely employed is comprised of a chamber frame having 10 to 100 mm in thickness. Pipes having such a diameter as can be located at the chamber frame (i.e. a diameter smaller than thickness of the frame) are positioned at several places of the cell, through which pipes solutions are supplied to or removed from the cell. Halogen gas evolved at the anode ascends upwardly through nearly overall space in the anode chamber and arrives at the upper part of the anode chamber. However, since the space (capacity) of pipes for removal of halogen gas is always smaller than that of the anode chambers, as stated earlier, it is very difficult to effectively remove halogen gas from the neighbourhood of the ion exchange membranes and the anodes.

In an attempt to overcome the above deficiencies of the conventional processes, a series of study have been made by the present inventors and the present invention has been completed.

The present invention is to provide an apparatus for the electrolysis of an aqueous alkali metal chloride solution using an electrolytic cell which is partitioned by a cation exchange membrane into an anode chamber and a cathode chamber, the improvement which comprises positioning an anolyte solution exit above the upper end of the cation exchange membrane to provide gas-liquid interface at which halogen gas generated is separated from the anolyte solution, and said gas-liquid interface being larger than the cross section area of the unit anode chambers opposing to cathodes.

More specifically, in the present electrolytic cell, the anode chamber is comprised of a plurality of unit anode chambers made up of the spaces formed by anodes and cathodes opposing to each other, and the upper and lower connecting anode chamber portions which connect a unit anode chamber with an adjoining unit anode chamber at upper and lower parts of the cell. The cathode chamber is comprised of a plurality of unit cathode chambers surrounded with unit anode chambers and the upper and lower anode chamber portions. The cell of the present invention is such that the gas-liquid interface in the anode chamber is substantially equivalent to the sum total of cross section area of unit anode chambers and unit cathode chambers. Accordingly, the present invention enables effective and smooth gas-liquid separation without residence of halogen gas in a unit anode chamber. The present invention does not require installation of a gas-liquid separator, and hence is very advantageous economically.

Further, since the upper and lower connecting anode chamber portions are specifically provided, individual and separate supply of brine into each of unit anode chambers is no longer required. That is, brine is supplied uniformly and automatically into each unit anode chamber through at least one brine supply inlet located at the lower connecting anode chamber portion. Moreover, in the present electrolytic cell the cathode chamber comprises a connecting cathode chamber wherein unit cathode chambers opposing to the anodes are connected with one another through the peripheral portion. Thus, while a filter press type electrolytic cell never fails to require circulation of a great amount of the catholyte solution to provide the uniform concentration, the present invention needs no such circulation and the concentration of the catholyte solution is uniformly maintained automatically.

Normally, the concentration of alkali metal hydroxide liquor (catholyte solution) ranges from about 10% to about 40%, and thus water or a dilute aqueous solution of alkali metal hydroxide is added as a diluent to the catholyte solution to maintain a desired concentration. When not diluted, the catholyte solution concentration to more than 40% to afford adverse effects to the cation exchange membrane.

In the present electrolyte cell, the addition of water or a dilute aqueous solution alkali metal hydroxide to each of unit cathode chambers is not necessary at all, the concentrations of each unit cathode chambers are uniformly controlled with addition through at least one diluent supply inlet. The catholyte solution in each unit cathode chamber goes up while enfolding hydrogen gas generated at the cathode and in the peripheral portions the catholyte solution goes down. Hence, it is preferred to position the diluent supply inlet at the lower part of the peripheral portions of the cathode chamber. That is, a dilute aqueous solution of alkali metal hydroxide has a lower specific gravity than the catholyte solution, and consequently it ascends upwardly, then being mixed perfectly with the descending stream in the peripheral portions, thereby supplied into each unit cathode chamber. Adversely, if the diluent supply inlet is provided at the upper part, water or a dilute alkali metal hydroxide aqueous solution with a lower specific gravity resides in the upper portion, thus resulting in irregular concentrations.

The present electrolytic cell is so particularly devised that the distribution of concentration in the unit anode and cathode chambers is maintained with ease, and hence, it reduces the number of brine or diluent supply inlet remarkably as compared with a filter press type electrolytic cell. It is preferred economically to provide one brine or diluent supply inlet at the cathode chamber per 5 square meters or more of the cation exchange membrane. The brine or diluent supply inlet exceeding the above increases the equipment cost.

Therefore, according to the present invention, operational control and maintenance can be surprisingly simplified and operation cost can be markedly reduced.

In addition, due to no residence of halogen gas, cell voltage is reduced as compared with conventional processes, thus leading to low electric power consumption.

Furthermore, the gas-liquid interface is provided at the upper position of the cell, apart from the upper end of the cation exchange membrane, so that halogen gas is not in contact with the cation exchange membrane. Hence, life of the membrane is extended.

The cation exchange membrane used in the present invention includes a fluorinated membrane conveying cation exchange groups such as a perfluorosulfonic acid perfluorohydrocarbon polymer membrane, which is sold under the trademark "Nafion" by E. I. Du Pont de Nemours & Company. The perfluorosulfonic acid perfluorohydrocarbon polymer membrane used in the Examples described later has the following structure;

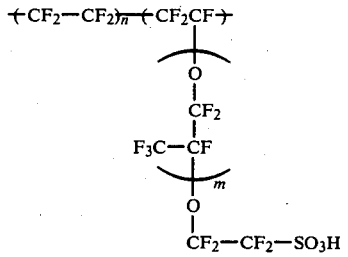

wherein the concentration of exchange groups are described as about 1,100 to 1,500 g of dry membrane per an equivalent of $SO_3^-$ exchange groups. Such cation exchange membranes may be also employed as having weak acid groups of carboxylic acid, phosphoric acid and the like, solely or in combination of sulfonic acid aforesaid.

The electrolytic cell used in the present invention is not specifically limited and any cell of filter press type or finger type well-known to the art are employed.

In application of the present invention to a finger type cell, the cation exchange membrane had best be installed to the cell according to the manner disclosed in Japanese Patent Publication (non-examined) No. 100,952/1979.

The cathode material used suitably in the present invention is an electroconductive material resistant to catholyte such as iron, steel, nickel or an alloy thereof. The shape of the cathode is, for example, an expanded metal mesh, a metal plate having perforations or slits, rods or the like.

The anode material used suitably in the present invention is an anolyte-resistant valve metal such as titanium, tantalum, zirconium, tungsten or the like. A valve metal serving as the anode includes platinum group metals, mixed oxides of valve metals and platinum group metals or the like. The anode may be in various shapes such as an expanded metal mesh, a metal plate having perforations or slits, rods or the like.

The present invention will be explained in more detail by way of drawings illustrating a preferred embodiment.

Figure 2:
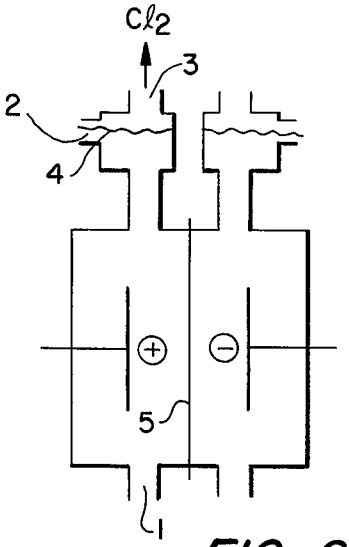

FIG. 1 or FIG. 2 depicts a schematic sectional view of a conventional electrolytic cell using an ion exchange membrane. The numeral (5) is a cation exchange membrane. Brine is introduced through a brine supply inlet (1) into an anode chamber wherein chlorine gas generated is separated at a gas-liquid interface (4). The numeral (3) is a chlorine gas exit and (2) is a depleted brine exit.

Figure 3:
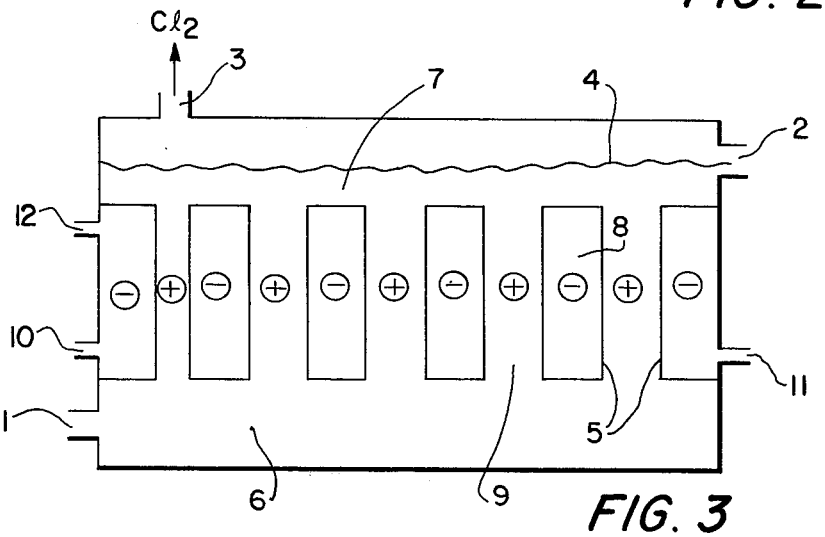

FIG. 3 shows a schematic sectional view illustrating a preferred embodiment of the present invention. The numeral (5) is a cation exchange membrane, (9) is a unit anode chamber and (8) is a unit cathode chamber. (7) and (6) are upper and lower connecting anode chamber portions, respectively. The upper and lower connecting anode chamber portions are connected with each other through the unit anode chambers (9), thereby constituting the anode chamber. Brine introduced through the brine supply inlet (1) is electrolysed in each unit anode chamber (9) to become depleted brine. The depleted brine ascends upwardly while enfolding chlorine gas evolved, then arrives at the upper connecting anode chamber portion (7). In the upper connecting anode chamber portion (7), a gas phase comprising chlorine gas is separated from a liquid phase comprising depleted brine, and chlorine gas separated off is discharged through the chlorine gas exit (3) from the electrolytic cell.

Depleted brine is discharged through the depleted brine exit (2) from the cell. The numeral (10) is an adding water inlet, (11) is an aqueous alkali metal hydroxide liquor exit and (12) is a hydrogen gas exit.

Figure 4:
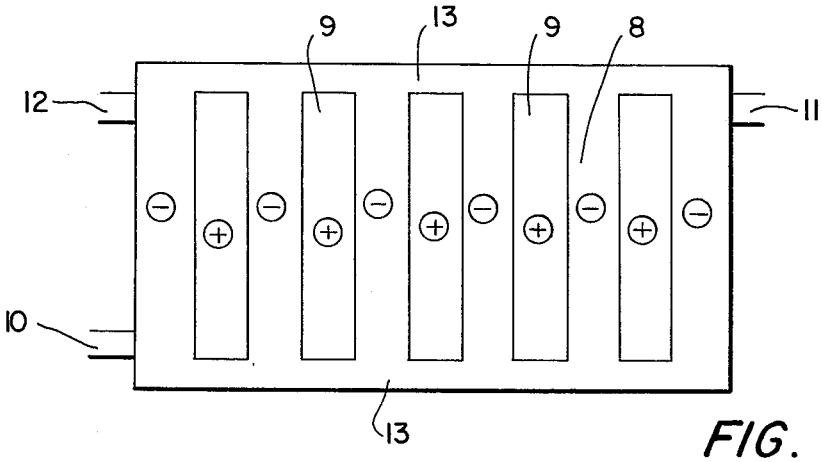

FIG. 4 illustrates a schematic top plan view showing another embodiment of the present invention. It indicates that unit cathode chambers (8) are connected with one another through the peripheral portion (13).

The present invention is designed so that the greater gas-liquid interface is provided than the sum total of cross section area of the unit anode chambers. By so specifically devising, substantially no chlorine gas resides in the anode chamber, chlorine gas ascends upwardly very effectively, thus to result in low power operation. Not only that, but is a high pure alkali metal hydroxide obtained. Further, the present invention is also designed so that the unit anode chambers are connected through the upper and lower connecting anode chamber portions, and the unit cathode chambers are also connected through the peripheral portion. Accordingly, operation control is unexpectedly simplified.

What is claimed is:

1. Apparatus for the electrolysis of an aqueous alkali metal chloride solution comprising an electrolytic cell which is partitioned by a cation exchange membrane into an anode chamber and a cathode chamber, wherein at least one anolyte solution exit is positioned to the anode chamber above the upper end of the cation exchange membrane, and wherein a gas-liquid interface having a surface area, at which halogen gas generated in the anode chamber is separated from the anolyte solution, is larger than the sum total of the horizontal cross section areas of unit anode chambers opposing to cathodes.

2. Apparatus of claim 1, further comprising a plurality of cells wherein said unit anode chambers are connected with adjoining unit anode chambers through upper and lower contiguous connecting anode chamber portions.

3. Apparatus of claim 1, wherein at least one supply inlet of diluent water or a dilute aqueous solution of alkali metal hydroxide for diluting alkali metal hydroxide produced in the cathode chamber and at least one exit of aqueous alkali metal hydroxide liquor are provided at the lower portions of the cathode chamber.

4. Apparatus of claim 1, wherein one supply inlet of the aqueous alkali metal chloride solution is provided at the anode chamber and one supply inlet of diluent water or a dilute aqueous solution of alkali metal hydroxide is provided at the cathode chamber per 5 square meters or more of the cation exchange membrane.

* * * * *